US005430903A

United States Patent [19]

Pence

[11] Patent Number: 5,430,903

[45] Date of Patent: Jul. 11, 1995

[54] SUSPENDED WALKWAY

[76] Inventor: Westing E. Pence, 97 Timber Ct., Oak Brook, Ill. 60521

[21] Appl. No.: 124,813

[22] Filed: Sep. 21, 1993

[51] Int. Cl.[6] ..... E01D 18/00

[52] U.S. Cl. ..... 14/7; 182/82; 248/235; 14/71.1

[58] Field of Search ..... 14/71.1, 71; 182/82; 248/214, 217.1, 235, 236; 404/1

[56] References Cited

U.S. PATENT DOCUMENTS 4,179,090 12/1979 Williams et al. ..... 182/82

FOREIGN PATENT DOCUMENTS 2683246 5/1993 France .

*Primary Examiner*—Ramon S. Britts
*Assistant Examiner*—Pamela A. O'Connor
*Attorney, Agent, or Firm*—Schiff Hardin & Waite

[57] ABSTRACT

A removable walkway is constructed of light metals and is designed for attachment to a bridge or viaduct during construction or repair, or for retrofitting such a structural built without a walkway.

10 Claims, 2 Drawing Sheets

SUSPENDED WALKWAY

The present invention relates to a walkway that is attachable to an existing bridge (or a viaduct, or any other similar structure), particularly for use during construction or repair of the bridge, or at other times when pedestrian or bicycle access over the bridge is limited. It may also be used to add a walkway to a structure that was originally designed or constructed without a walkway.

BACKGROUND OF THE INVENTION

It has long been a problem that, during construction or repair of a bridge, pedestrian access has been restricted or eliminated because such work frequently requires that walkways be torn up, or used as staging areas for work crews and equipment. These repairs often require that all traffic be diverted from the bridge along alternate routes, sometimes many miles away from the destination. While automobile traffic is inconvenienced by these detours, pedestrians and bicyclists can be effectively cut off from their destinations by closure of a bridge because of the distances involved, or because of other obstacles such a road conditions, lack of walkways or paths, or the like. In addition, bridges have been built without pedestrian walkways, forcing pedestrians and bicycles to share the roadway with vehicular traffic, or to take another route.

As a result, it has long been desired to provide a means for permitting pedestrian and bicycle traffic to pass over a bridge while construction is underway and to provide means to retrofit existing structures with pedestrian walkways. At the same time, such means must not interfere with the construction or repair that is underway or with vehicular traffic. Likewise, if the costs of providing such means is too great, already constrained repair budgets will not permit the installation of such means in many, if not most, repair and construction projects. The means so provided must also provide a safe location for pedestrian and bicycle traffic to pass while construction and repair is occurring.

SUMMARY OF THE INVENTION

The present invention meets these needs by providing a low cost, safe and unintrusive temporary pedestrian walkway that is also suitable for bicycle use. According to the invention, a walkway is constructed comprising at least one bracket including a retaining portion for retaining the walkway along a side of the bridge and suspending it therefrom, first members connected to each bracket and extending substantially perpendicular from a plane along the surface of the bridge, second members extending substantially perpendicular from the first members and away from the side of the bridge, clamping means for joining the first and second members and for biasing the walkway against a lower surface of the bridge preventing rotation of walkway about a moment, third members extending upward from the second members and substantially in parallel to the first members, at least one fourth member extending substantially normal to the plane formed by the first, second and third members, and connected to the second member, and, a base extending between the first and third members, and supported by the second members.

It is an object of the invention to provide a pedestrian walkway for use during bridge construction and repair that is of low cost to construct and install.

Another object of the invention is to provide such a walkway in a place that does not interfere with ongoing construction and repair work.

Still another object of the invention is to provide such a walkway in a location that is safe for pedestrian traffic even while construction and repair is ongoing.

Another object of the invention is to provide economical means to retrofit existing bridges that lack pedestrian walkways.

Yet another object of the invention is to provide such a walkway that can be used on a temporary or permanent basis without drilling or otherwise mechanically attaching the walkway to the bridge.

DETAILED DESCRIPTION OF THE INVENTION

The walkway of the present invention is designed to be removably attached to the superstructure of a bridge, and particularly to the sides of such a structure. Thus, in the embodiment shown in FIGS. 1 and 2, the bridge structure 10 is constructed using conventional, cast concrete structures for the base of the roadbed 15 and for each side 20. Because it may be attached outside of the supports for the bridge, a moment may be created that would cause the structure to unduly stress those supports. To minimize that possibility, it is desirable to construct the walkway 25 from a strong, light material, such as aluminum or an aluminum alloy. Other lightweight, strong materials (such as magnesium and magnesium alloys, graphite, and the like) may also be used to construct the walkway.

Of course, the dimensions of each structural member of the invention will depend upon such factors as the size and mass of the load to be transported over the walkway, the dimensions and design of the bridge, and the materials present in the structure. The calculation of these dimensions from analysis of static and dynamic forces present in the structure is straightforward and routinely performed by engineers practicing in the field. Therefore, it will be understood that the following description is made without reference to dimensions, which will be selected for each particular embodiment of the invention but which are not important to the invention itself.

Figure 2:
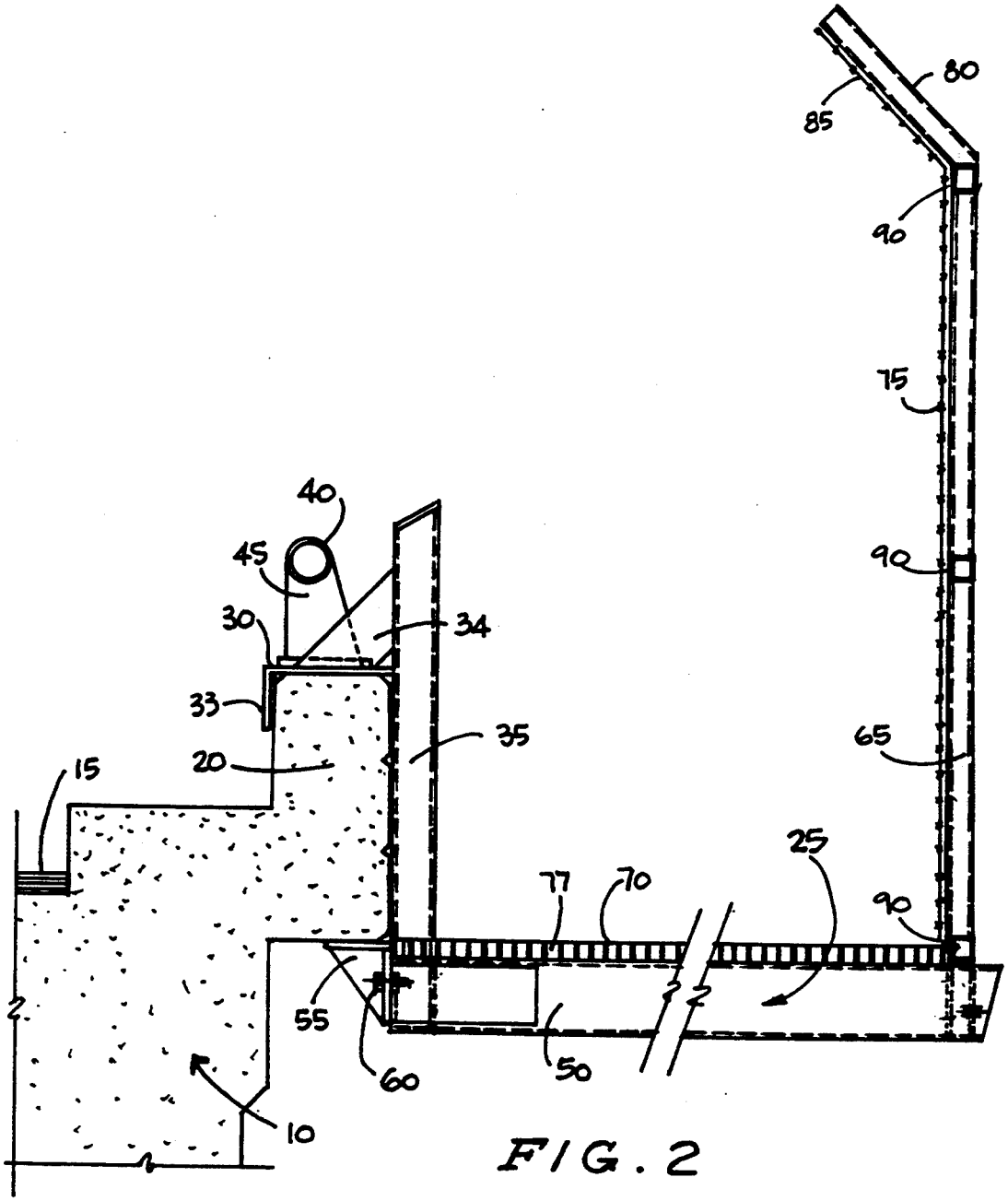
FIG. 2 is a cross-sectional view of the embodiment depicted in FIG. 1, taken substantially in the plane of line 2—2 of FIG. 1.

Referring to FIG. 2, walkway 25 is suspended from bridge structure 10 by a generally L-shaped support bracket 30, which is connected to inner vertical member 35. Bracket 30 may be integrally constructed with inner member 35, as by casting or welding, or may be riveted or bolted to inner member 35 to provide secure attachment. Inner member 35 is preferably made from an aluminum tube of circular or preferably rectangular cross-section to provide strength and rigidity while at the same time being light in weight; nevertheless, other materials may be used, as noted above. Because the side 20 of the bridge structure 10 may include one or more rails 40 (which may be guardrails or handrails) joined to side 20 by a plurality of discretely spaced supports 45 that are bolted or set into the side 20, bracket 30 may be a plurality of brackets spaced between said supports 45.

Bracket 30 includes retaining portion 33 and adjoining portion 34.

Inner member 35 is joined at its lower end to horizontal member 50, which preferably is made of the same material as inner member 35. Joining is accomplished by any suitable means to provide rigid structural support under the anticipated loads, as for example by clamp 55 as shown in FIG. 2. Clamp 55 is joined to both inner member 35 and horizontal member 50 by bolt 60, and is configured to bias horizontal member 50 against the underside of the bridge structure 10. This configuration acts to counter the moment (which is clockwise in FIG. 2) created by the walkway itself and increased as a load is placed on walkway 25, so that the load is fully supported by clamp 55 and retaining portion 33 of bracket 30. Accordingly, the materials used for clamp 55 and bracket. 30 must be capable of supporting the anticipated loads.

At the end of horizontal member 50 opposite clamp 55, outer member 65 is joined to horizontal member 50 by any secure means such as a bolt, a weld or preferably a mechanical interlock for easy construction and demolition. Outer member 65 is preferably made from the same material, and has the same construction, as members 35 and 50.

Figure 1:
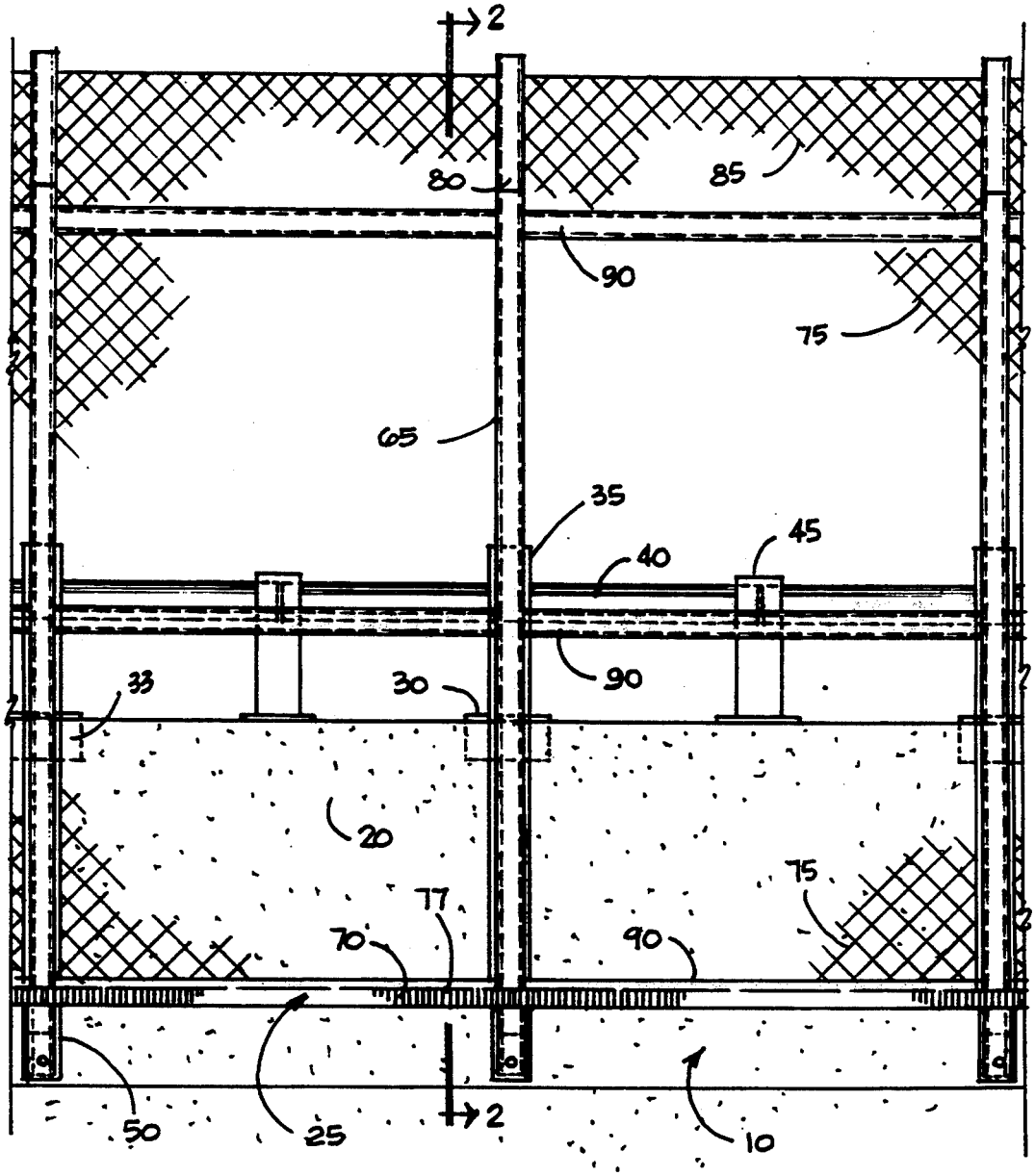
FIG. 1 is an elevational view of an embodiment of the walkway of the present invention.

The configuration of these elements, shown in FIG. 1, is repeated along the length of the walkway 25 at intervals determined by the routine engineering calculations mentioned above. Extending for that length, in one or more discrete sections, is base material 70, which preferably is an aluminum or other structural grating materials. Base material 70 rims substantially from inner member 35 and outer member 65, and is supported by horizontal members 50. Base material 70 preferably includes a plurality of holes 77, as found in a grating, to permit drainage and to avoid the build-up of snow or ice and provide a traction-enhancing surface during inclement weather.

Finally, to provide structural rigidity to the walkway, cross member 90, which may be formed in one or more sections along the length of the walkway, is provided substantially normal to the plane defined by horizontal member 50 and outer member 65, as shown best in FIG. 2. Cross member 90 is preferably made from the same material as the other members 35, 50 and 65 (such as aluminum or an alloy), and preferably has a rectangular cross-section to impart structural rigidity. Cross member 90 is operably connected to horizontal member 50 by extending through a hole formed in member 50 (as shown in FIG. 2) or by other mechanical engagement.

Also extending substantially the length of walkway 30 is screening material 75, which is preferably chain-link fencing material because of its light weight, its strength, its low cost and its ease of installation. This screening material reduces the likelihood that a pedestrian or cyclist would fall from the walkway to the area below the bridge, and also inhibits vandals and hooligans from dropping things onto that area. Such screening material may optionally be extended between inner members 35 to similarly prevent egress from the walkway to the bridge when repair or construction is underway and where equipment may be stored. Alternatively, screening material 35 may comprise other materials (for example, wire, barbed wire, metal bars, gratings, wood planks, plexiglass, or plywood sheets) providing a similar screening effect. Screening material 75 may be provided as a single section or as a plurality of sections. More than one such material may be used at one time.

When such screening material is provided, it may be desirable to include angled segment 80 at the upper portion of support 65 (and, if screening material is used along inner supports 35, there as well), which may be integral with or securely attached to the support. Angled segment 80 preferably is configured to extend from the support 65 (and/or 35) upward and in the direction of the opposite vertical supports, so that screening material 85 extending between the angled segments is suspended at least partially over base material 70. These angled segments, and the screening material 85 extending therebetween, inhibit climbing over the screening material by vandals and hooligans.

As already noted, the walkway of the present invention may be used without drilling or otherwise mechanically attaching the walkway to the bridge. Nevertheless, the walkway can be used with mechanical attachment, as by bolting, through the bracket 30, clamp 55 or other locations, without departing from the invention, since the principal support will come from bracket 30 and clamp 55.

Thus, the walkway of the present invention provides numerous advantages not heretofore available. The invention has been described with respect to certain embodiments and conditions, which are not meant to and should not be construed to limit the invention. Those skilled in the art will understand that variations from the embodiments and conditions described herein may be made without departing from the invention as claimed in the appended claims.

What is claimed is:

1. A walkway for use during construction or repair of a bridge, or for a permanent addition to a bridge structure built without a walkway area for pedestrians and bicycles, comprising:

at least one bracket including a retaining portion for retaining the walkway along a side of the bridge and suspending it therefrom;

inner vertical members connected to each bracket and extending substantially perpendicular from a first plane along the road bed of the bridge;

horizontal members extending substantially perpendicular from the inner vertical members and away from the side of the bridge;

clamping means for joining the inner vertical and horizontal members and for biasing the walkway against a lower surface of the bridge preventing rotation of the walkway;

outer members extending upward from the horizontal members and substantially in parallel to the inner vertical members, such that each combination of inner vertical, horizontal and outer members defines a second plane;

at least one cross member extending substantially normal to the second plane formed by each inner vertical, horizontal and outer member, and connected to the horizontal member; and, a base extending between the inner vertical and outer members, supported by the horizontal members.

2. The walkway of claim 1, further comprising screening material extending between the outer members.

3. The walkway of claim 2, wherein said screening material is selected from the group consisting of chain-link fence, wire, barbed wire, metal bars, gratings, wood planks, plexiglass, and plywood sheets.

4. The walkway of claim 1, wherein the outer member includes an angled section at its upper end, the angled section extending upward and in the direction of the inner vertical member.

5. The walkway of claim 4, wherein the inner vertical member includes an angled section at its upper end, the angled section extending upward and in the direction of the outer member.

6. The walkway of claim 1, wherein the inner vertical, horizontal, outer and cross members are made from a material selected from the group consisting of light metals, light metal alloys and composite materials.

7. The walkway of claim 6, wherein the material is aluminum.

8. The walkway of claim 7, wherein the aluminum is provided in the form of tubes.

9. The walkway of claim 1, wherein the base is a metal grating.

10. A walkway for use during construction or repair of a bridge, or for a permanent addition to a bridge structure built without a walkway area for pedestrians and bicycles, comprising:

at least one bracket including a retaining portion for retaining the walkway along a side of the bridge and suspending it therefrom;

inner vertical members connected to each bracket and extending substantially perpendicular from a first plane along the road bed of the bridge;

horizontal members extending substantially perpendicular from the inner vertical members and away from the side of the bridge;

clamping means for joining the inner vertical and horizontal members and for biasing the walkway against a lower surface of the bridge preventing rotation of the walkway;

outer members extending upward from the horizontal members and substantially in parallel to the inner vertical members, such that each combination of inner vertical, horizontal and outer members defines a second plane;

at least one cross member extending substantially normal to the second plane formed by each inner vertical, horizontal and outer member, and connected to the horizontal member;

wherein said inner vertical, horizontal, outer and cross members are made from a material selected from the group consisting of structural aluminum tubing and other lightweight structural materials;

chain-link fencing extending between the horizontal members;

a grating extending between the inner vertical and outer members, supported by the horizontal members.

* * * * *

UNITED STATES PATENT AND TRADEMARK OFFICE

CERTIFICATE OF CORRECTION

PATENT NO. : 5,430,903

DATED : July 25, 1995

INVENTOR(S) : Yang, et al.

It is certified that error appears in the above-indentified patent and that said Letters Patent is hereby corrected as shown below:

On the title page, item [75], order of the inventors has changed to: Henry Sho-Che Yang
Kadangode K. Ramakrishnan
Anthony G. Lauck
William R. Hawe Signed and Sealed this Twenty-sixth Day of December, 1995

Bruce Lehman

*Attest:*

BRUCE LEHMAN

*Attesting Officer*

*Commissioner of Patents and Trademarks*